350-407

SR

XR 4,215,929 TR 350 - 407

United States Pa 4,215,929

Sato et al.

Aug. 5, 1980

[54] IMAGE FORMING METHOD AND APPARATUS CAPABLE OF CONTROLLING AN ELECTROSTATIC IMAGE FORMATION AREA

[75] Inventors: Tadashi Sato, Kokubunji; Atsushi Kubota, Komae, both of Japan

[73] Assignee: Canon Kabushiki Kaisha, Tokyo, Japan

[21] Appl. No.: 942,119

[22] Filed: Sep. 13, 1978

[30] Foreign Application Priority Data

Sep. 17, 1977 [JP] Japan ..... 52/111873
Feb. 28, 1978 [JP] Japan ..... 53/23048

[51] Int. Cl.[3] ..... G03G 15/00

[52] U.S. Cl. ..... 355/7; 350/159; 355/71; 355/77; 430/31

[58] Field of Search ..... 355/7, 3 R, 16, 11, 355/71, 77; 96/1 R; 350/159

[56] References Cited

U.S. PATENT DOCUMENTS

| | | | |
|---|---|---|---|
| 3,621,231 | 11/1971 | Craig | 350/159 X |
| 3,671,104 | 6/1972 | Seino | 350/159 X |
| 3,967,896 | 7/1976 | Looney et al. | 355/7 X |
| 4,133,609 | 1/1979 | Arai | 355/71 X |

*Primary Examiner*—R. L. Moses
*Attorney, Agent, or Firm*—Fitzpatrick, Cella, Harper & Scinto

[57] ABSTRACT

A method and an apparatus for carrying out a kind of trimming operation in electrophotography, wherein a control light of an image region is irradiated onto a photosensitive body through masking members to thereby eliminate electric charge on the photosensitive body and to control the forming region of an electrostatic latent image. The masking members, in their single form, permit the light to pass therethrough, and intercept the same in their overlapped form, polarizing plates being used for the masking members. The latent image formation in the breadthwise direction of the image original is controlled by an overlapping degree of the masking members. The electrostatic latent image formation in the direction perpendicular to the breadthwise direction of the image is controlled by moving the masking members in their overlapped state in synchronism with movement of the photosensitive body, across the light path of the control light in the image region. By these operations, only a desired image region can be reproduced from the image original.

25 Claims, 42 Drawing Figures

IMAGE FORMING METHOD AND APPARATUS CAPABLE OF CONTROLLING AN ELECTROSTATIC IMAGE FORMATION AREA

BACKGROUND OF THE INVENTION a. Field of the Invention

This invention relates to an electrophotographic method and an apparatus therefor. More particularly, it is concerned with an image forming method and an apparatus which make it possible to selectively reproduce only the required region of an image original.

b. Description of the Prior Arts

Heretofore, when a required region of an image original is selected for reproduction (or copying), there have been adopted various methods such that: (1) a part of the image original is cut out; (2) the unnecessary portion of the image original is folded so as not to be exposed to light; (3) the unnecessary portion of the image original is covered with a masking member such as white paper, etc., and various other methods. Of these, the methods (1) and (2) are inefficient, because the work is done manually, and moreover they are impossibly applicable to those image original which is books or other hard materials. On the other hand, the method (3) is difficult to set the masking position on the image original; in particular, when the image original is placed on a image original placing table, the marking condition of the image original cannot be verified by an operator, which makes it difficult to set the masking position.

In view of the above-described inconveniences, there have so far been contemplated the following methods for obtaining only the required portion of the image original from the electrophotographic reproduction apparatus.

(i) In the electric charging step, the unnecessary image region on the photosensitive body is prevented from being charged.

(ii) In the developing step, the unnecessary image region on the photosensitive body is prevented from being developed.

(iii) In the image transfer step, the unnecessary image region on the photosensitive body is prevented from being transferred.

Since the abovementioned three methods (i), (ii), and (iii) do not visualize the unnecessary image region, it is necessary to partially interrupt the charging, developing or image-transferring operation. For this purpose, it is required to interpose a covering or masking member between the photosensitive body and each of the abovementioned processing means, or to effect complicated electrical control operations. In addition, the abovementioned three methods tend to lack in accuracy their operation. For example, in the method (i), a boundary between the electrically charged section and the noncharged section of the photosensitive body becomes ambiguous owing to the covering member interposed between the corona discharge electrode and the photosensitive body with the consequent inability to form an image, in which such desired required image region is clearly distinguished by a very sharp and clear boundary line. In the methods (ii) and (iii), toner particles adhered onto the covering member are liable to contaminate the image transfer material and the photosensitive body.

SUMMARY OF THE INVENTION

It is the primary object of the present invention to provide a novel method and apparatus for image formation which have solved the complexity in operation, inconveniences in handling, and ambiguity at the image boundary portion, all of which are inhevent in the conventional methods and apparatuses at the time of eliminating the unnecessary image region.

It is the secondary object of the present invention to provide a method and an apparatus for image formation, in which a portion of the image original is retained as the image for reproduction, and the surrounding region is eliminated.

It is the third object of the present invention to provide a method and an apparatus for image formation, in which a surrounding portion of the image original is retained as the necessary image for reproduction, and the remaining image region enclosed thereby is eliminated as an unnecessary image region.

It is the fourth object of the present invention to provide a method and an apparatus for image formation, in which the size of the necessary image region and of the unnecessary image region can be arbitrarily changed.

It is the fifth object of the present invention to provide a method and an apparatus for image formation, in which a necessary image region can be selected from an image original projected on a monitoring device.

It is the sixth object of the present invention to provide a method and an apparatus for image formation, in which retention of the abovementioned image region as necessary for reproduction or its elimination as unnecessary for reproduction can be easily selected.

According to the present invention, briefly speaking, there is provided a method for image formation, wherein an electrostatic latent image is formed on a photosensitive body by combination of electric charging and image exposure, and this latent image is developed for reproduced image, which comprises: (a) the step of maintaining masking means in a state of being away from a light path of a control light until the front end of a necessary or an unnecessary region of an electrostatic latent image to be formed on a photosensitive body reaches the irradiating region of said control light, when the electrostatic latent image of the necessary region alone formed by moving the masking means including masking members which permit the control light to pass substantially therethrough in their single form, and substantially intercept the light when they are overlapped; (b) the step of moving the masking means to intercept the light path of the control light in synchronism with the travelling of the front end of the image region, when the front end of the electrostatic latent image reaches the irradiating region of the control light; (c) the step of causing said masking means to be kept in its state of perfectly covering the light path of the control light until the rear end of the necessary or unnecessary electrostatic latent image region arrives at the irradiating region of the control light outo the photosensitive body; (d) the step of moving the masking means away from the light path of the control light in synchronism with the travelling of the rear end of the electrostatic latent image region, when the rear end thereof arrives at the irradiating region of the control light; and (e) the step of reinstating the masking means to the original position thereof upon completion of the electrostatic latent image formation.

The foregoing objects, other objects as well as the characteristic features of the present invention will become more apparent and understandable from the following detailed description thereof, when read in conjunction with the accompanying drawing.

DETAILED DESCRIPTION OF PREFERRED EMBODIMENTS

It should be understood that the present invention is applicable to reproduction machines, recording devices using laser beam, and so on. In the following detailed explanations, however, an embodiment of the electrophotographic reproduction apparatus adopting the slit-exposure system, to which the present invention is applied, will be taken as an example.

Figure 1:
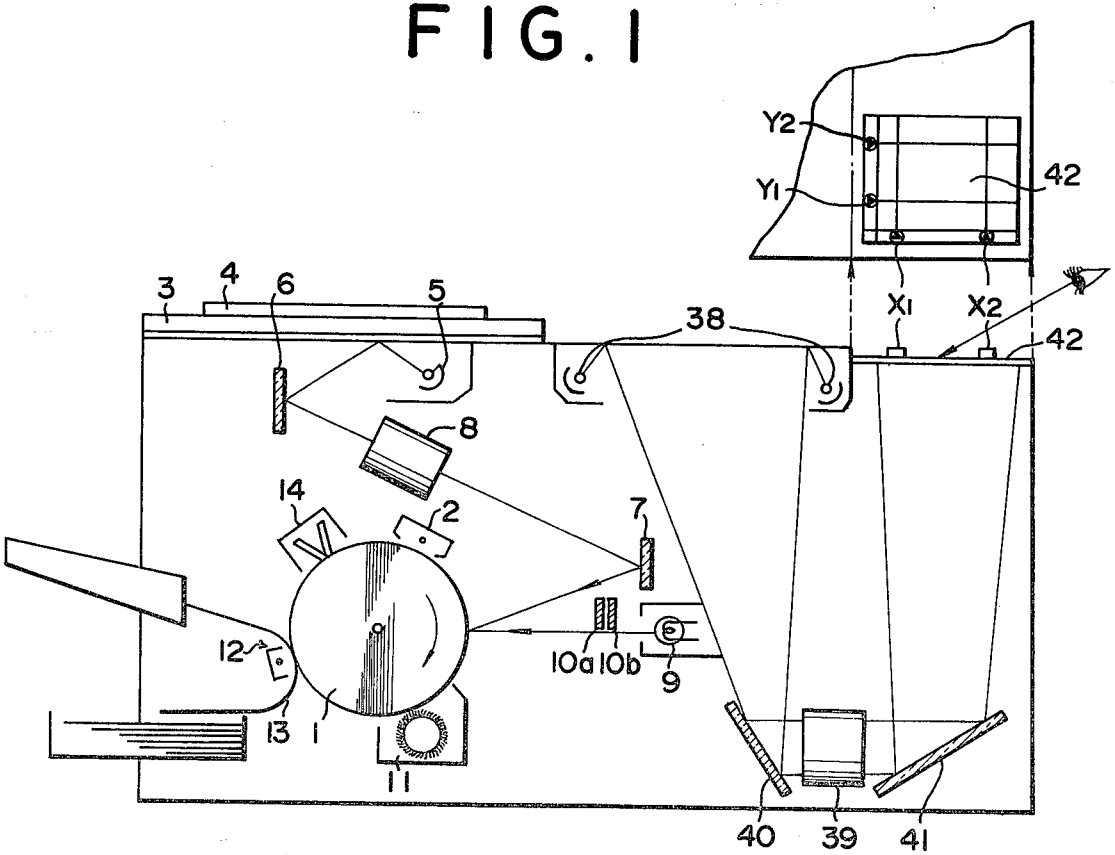
FIG. 1 is a schematic side elevational view of a reproduction apparatus having a control mechanism and a monitoring mechanism for the image region.

Referring first to FIG. 1, a drum-shaped photosensitive body 1 rotating in an arrow direction consists of an electrically conductive layer and a photoconductive layer, and is charged by a corona discharger 2. Subsequently, an image original 4 on an image original placing table 3 is illuminated by an illuminating lamp 5 beneath the table 3, and the image is focussed on the photosensitive body 1 through an optical system consisting of reflecting mirrors 6, 7 and a lens 8. As the result, an electrostatic latent image is formed on the photosensitive body. In this instance, in order to eliminate the electrostatic latent image of an unnecessary image region on the photosensitive body 1, a control light of the image region is irradiated from a light source 9 for controlling the image region, and the abovementioned control light is controlled in accordance with an overlapped portion of the masking members 10*a* and 10*b* constituting the masking means, whereby the electrostatic latent image of the unnecessary image region on the photosensitive body is eliminated. Thus, the electrostatic latent image of the necessary image region on the photosensitive body which has thus been formed by eliminating the electrostatic latent image of the unnecessary image region is subsequently developed by a developer, and transferred onto an image transfer paper 13 at an image-transfer section 12. Thereafter, the image on the image transfer paper 13 is fixed by an image fixing device (not shown) and discharged outside the apparatus. On the other hand, the photosensitive body 1 is wiped by a cleaning blade 14 for removing residual toner thereon to be prepared for the subsequent reproduction cycle.

Figure 2:
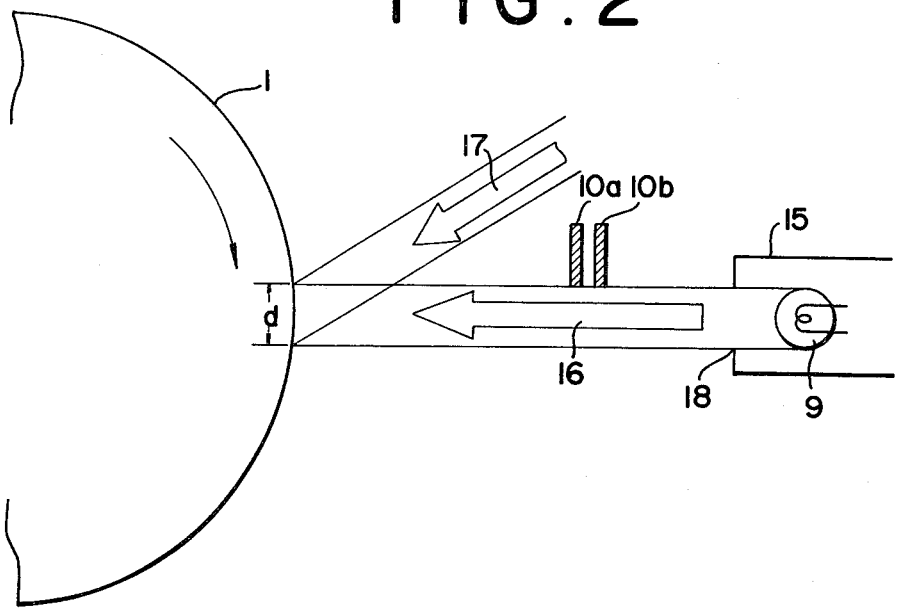
FIG. 2 is a schematic diagram to explain the control step of the image region.

FIG. 2 shows the principal part of the mechanism for controlling formation of the electrostatic latent image on the photosensitive body by controlling the control light of the image region by means of masking members, the part corresponding to the image exposure section in FIG. 1.

In the drawing, a light source 9 for controlling the image region consists of spot light sources sufficient in number to uniformly irradiate the photosensitive body 1 in the breadthwise direction thereof, or a linear light source having an irradiating width sufficient to irradiate the photosensitive body 1 in the entire axial direction thereof. This light source 9 also irradiates the control light 16 of the image region to control formation of the electrostatic latent image to thereby eliminate electric charge in the unnecessary image region on the photosensitive body 1. The light source 9 is positioned in a frame 15 for the light source in such a manner that it may be substantially horizontal with respect to the photosensitive body 1 to achieve uniform irradiation of the surface of the photosensitive body 1. The light source frame 15 is provided with a slit 18 to coincide the irradiating width of the control light 16 with the irradiating width d of an exposure light 17 from the image original. The masking members 10*a* and 10*b* constituting the masking means move across the light path of the control light 16 as necessary arises. Further, these masking members 10*a* and 10*b* intercept the control light 16 by overlapping to hinder the control light 16 to arrive at the photosensitive body 1. On account of this, the image remains thereon without being eliminated. However, at a portion where the members 10*a* and 10*b* do not overlap, the control light 16 is transmitted and the electric charge on the photosensitive body 1 is eliminated. As a result, the unnecessary image region is removed from the photosensitive body.

FIG. 3 shows a state of overlapping of the masking members. In this embodiment, use of a polarizing plate is taken as an example of the masking member in the explanations to follow hereinbelow.

Figure 3A:
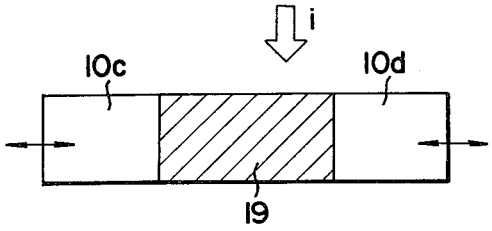
FIG. 3A is an explanatory diagram showing an overlapped state of the masking members (polarizing plate) constituting the masking means for use in the present invention.

In FIG. 3A, each of the masking members 10*c* and 10*d* consists of a polarizing plate which is constructed in such a manner that the polarizing direction of the members may orthogonally intersect. In the drawing, the portion 19 with diagonal hatching indicates the overlapped region of the masking members 10*c* and 10*d*. The polarizing plates 10*c* and 10*d* can be independently moved by control means (not shown) in the arrowed directions, whereby the overlapped region 19 of the polarizing plates can be established arbitrarily and continuously.

Figure 3B:
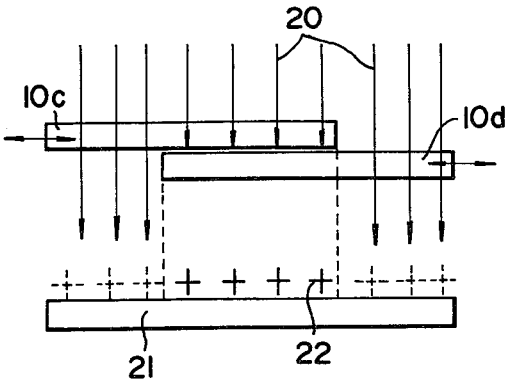
FIG. 3B is a schematic explanatory diagram for an electrostatic latent image formation using the abovementioned polarizing plate.

FIG. 3B shows an example of forming the electrostatic latent image on an arbitrarily limited region on the photosensitive body. The drawing shows the overlapped state of the polarizing plates 10*c* and 10*d* as viewed from the direction of an arrow mark i in FIG. 3A. The control light 20 from the image region is intercepted in such a manner that it is completely intercepted at this overlapped section, or to such an extent that does not render the photoconductive layer of the photosensitive body surface conductive, hence the electric charge on the photosensitive body may not be eliminated. On the other hand, the single polarizing plate portion at both sides (i.e. non-overlapped portion) transmits the control light 20 in an amount sufficient to perfectly eliminate the electric charge on the surface of the photosensitive body. Accordingly, as shown in FIG. 3B, the electrostatic latent image 22 (shown by the positive (+) electric charge) remains only on the light-intercepted portion of the photosensitive body 21, and the latent image is eliminated from the light-transmitted portion. It is to be noted that the polarizing plates need not necessarily be intersected orthogonally in their mutual polarizing direction, provided that the interception of the control light can be effected to such an extent that the electric charge on the photosensitive body may not be eliminated by the control light.

Further, the masking members are not limited to the polarizing plate alone, but any other materials which can achieve the abovementioned function and effects by the overlapping may of course be used. Therefore, any kind of material that produces the light intercepting effect of a degree that does not at least eliminate the electric charge on the photosensitive body and has a function of permitting light sufficient to eliminate the charge to pass therethrough in its single form may be freely used. For example, there may be used: (a) overlapped filters, each of which has a divided wavelength region so that light quantity may be equal depending on the spectroscopic sensitivity of the photosensitive body; (b) materials having large absorption coefficient with respect to light; and (c) overlapped polarizing plate and liquid crystal, in which the orientation of the liquid crystal is varied to obtain the abovementioned effects of the light transmission and the light interception.

Figure 4:
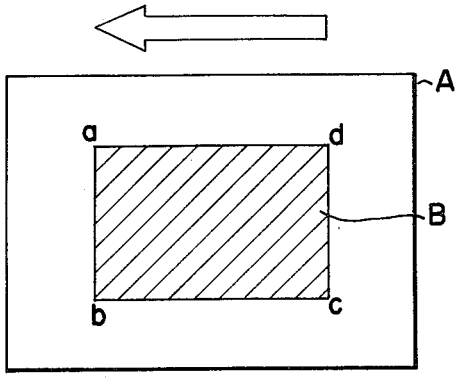
FIG. 4 is an explanatory diagram for a necessary image region B for reproduction.

FIG. 4 shows the total region A of an image original. In the drawing, a region with diagonal hatch lines (i.e., the diagonally hatched region enclosed by a-b-c-d) represents a necessary image region B and the other portion (white region) denotes an unnecessary image region. The image original A travels in the arrow direction, in the course of which it is sequentially scanned with a predetermined slit-exposure width. In the drawing, a length between a and b (hence d and c) corresponds to the width of the necessary image region B and a length between a and d (hence b and c) corresponds to a length of the region.

FIGS. 5A to 5H illustrate the operations of the polarizing plates to obtain the necessary image region B from the image original in FIG. 4. In FIGS. 5A through 5H, the illustrations at the left side (i.e., FIGS. 5A, 5C, 5E and 5G) indicate the cross-sectional views cut along the overlapped section of the polarizing plates 10*e* and 10*f*, and the illustrations at the right side (i.e., FIGS. 5B, 5D, 5F and 5H) explain the state of controlling by the polarizing plates the irradiating region 23 of the control light in the image region with respect to the exposure light of the image original on the photosensitive body. Incidentally, FIGS. 5A and 5B, FIGS. 5C and 5D, FIGS. 5E and F, and FIGS. 5G and 5H correspond to each other. In the left side illustrations in FIGS. 5A through 5H, both solid line and dot line around the periphery of the drum-shaped photosensitive body represent an image I to be formed from the image original assumed on the photosensitive body 1 as shown in FIG. 4, the image travelling along with rotation of the photosensitive body 1 in the arrow direction. In this image I, the solid line portion corresponds to the necessary image region (the region B in FIG. 4) and the dot line portion corresponds to the unnecessary image region (the white region in FIG. 4).

Figure 5A:
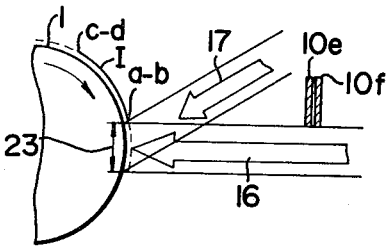
FIGS. 5A through 5H are respectively explanatory diagrams showing the conditions of synchronous movement of the polarizing plate with the photosensitive body.
Figure 5B:
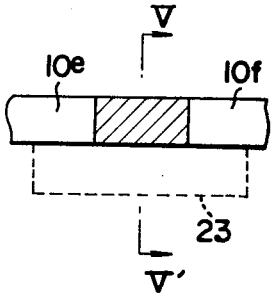

As shown in FIGS. 5A and 5B, the polarizing plates 10*e* and 10*f* are completely away from the light path of the control light 16 of the image region until the position of the front end a-b of the necessary image region on the image I reaches the light irradiating region 23, whereby the light irradiating region 23 on the photosensitive body 1 receives the control light 16 on its entire surface, and the electric charge at the abovementioned region is eliminated. As the result, the electrostatic latent image in the region from the front end of the image I to the position a-b thereof is completely eliminated, and, when a reproduced copy as shown in FIG. 4 is to be obtained, the portion corresponding to this exposed region remains white without any image being formed thereon.

Figure 5C:
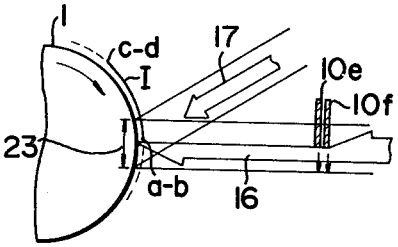
Figure 5D:
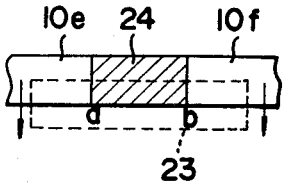

When the position a-d shown in the image I reaches the light irradiating region 23, the bottom ends of the polarizing plates 10*e* and 10*f* begin to lower in the arrow direction in synchronism with travelling of the front end position a-b of the image as shown in FIGS. 5C and 5D with both polarizing plates being in an overlapped state. Continuously, the polarizing plates 10*e* and 10*f* lower downward until they perfectly intercept the control light 16, and finally stop. This light-intercepted state is maintained until the rear end c-d of the necessary image region shown in the image I reaches the light irradiating region 23. Accordingly, irradiation of the control light 16 to the region corresponding to the overlapped portion 24 of the polarizing plates 10*e* and 10*f* is hindered, and the electrostatic latent image at this region remains without elimination. On the other hand, the control light 16 is irradiated onto the region corresponding to the portion where the polarizing plates do not overlap each other, and the electrostatic latent image at this region is eliminated.

Further, when the position c-d shown in the image I reaches the light irradiating region 23, the top end of the polarizing plates 10*e* and 10*f*, in their state of being overlapped with each other, begins to lower in the arrow direction in synchronism with travelling of the position c-d. It continues to lower until it is perfectly away from the light path of the control light 16, and finally stops. This state is maintained until the image I completely passes through the light irradiating region 23, i.e., until the scanning of the image original terminates. As the consequence, the electrostatic latent image in the region from the position c-d to the rear end of the image I is eliminated, and no image is formed at all in the region of a reproduced copy corresponding to this region as is the case with the region from the abovementioned front end of the image to the position a-b thereof. Accordingly, the image region B with hatched lines in FIG. 4 is only formed.

Figure 5E:
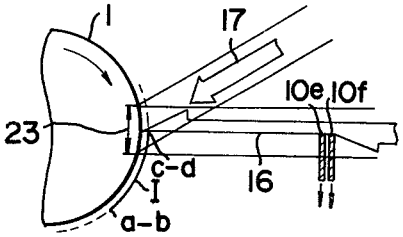
Figure 5F:
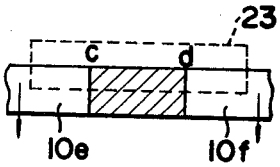
Figure 5G:
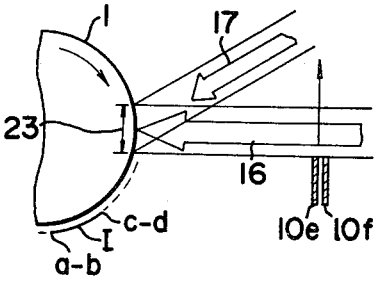
Figure 5H:
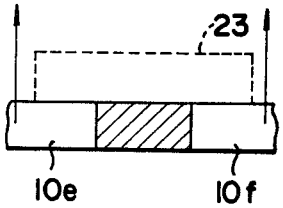

When the scanning of the image original terminates, the polarizing plates 10*e* and 10*f* rise upward in the arrow direction in FIGS. 5G and 5H to return to their original positions shown in FIGS. 5A and 5B.

The foregoing is one operative embodiment of the polarizing plates for obtaining the necessary image region out of the image original in accordance with the present invention. Thus, it will be understood that the image region B as illustrated by the hatch lines except for the surrounding portion of the image original can be obtained accurately and easily as a reproduced image having remarkable clarity at the boundary sections. Operations of the other polarizing plates will be explained in later paragraphs.

Figure 6:
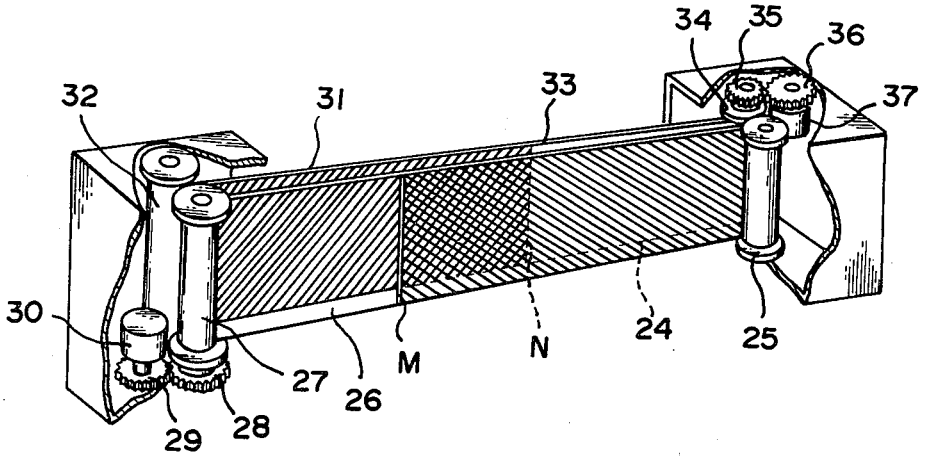
FIG. 6 is a perspective view showing one embodiment of the polarizing plate unit.

FIG. 6 shows a perspective view of one embodiment of the polarizing plate unit having two arbitrarily overlapping polarizing plates and control means to control these polarizing plates. The right end part of the polarizing plate 24 is wound up by a spool 25, on which back-tensioning force is acted. A spring may be used for creating this back tensioning force. The left end part of the polarizing plate 24 (a position M in the drawing), on the other hand, is connected with transparent film 26, the end of which is taken up on another spool 27 which is separately provided from the spool 25 in parallel therewith. A gear 28 is provided on the rotational shaft of the spool 27, and is meshed with a gear 29 provided on the rotational shaft of a motor 30. The setting position of the polarizing plate 24 is determined by a quantity of rotation of the motor 30.

In the same manner, another polarizing plate 31, the polarization direction of which orthogonally intersects with that of the polarizing plate 24, is disposed at a position in close vicinity of, or in contact with, the abovementioned polarizing plate 24. The left end part of the polarizing plate 31 is taken up by a spool 32 of the same construction as that of the spool 25. On the other hand, the right end part of the polarizing plate 31 (the position N in the drawing) is continuously connected with a transparent film 33 same as abovementioned. A further spool 34 to take up this transparent film 33 is disposed in parallel with the spool 32 at a position opposite to the spool. At one end of the rotational shaft of the spool 34, there is provided a gear 35 which is meshed with a gear 36 fixed to a motor 37. With the above-mentioned construction, the setting position for overlapping the polarizing plate 31 is determined by the rotational quantity of the motor 37.

When the polarizing plate 24 is pulled out of the spool 25 to the position M in the drawing, and the polarizing plate 31 is pulled out of the spool 32 to the position N in the drawing positioned in the opposite side of the spool 25, the section where the polarizing plates 24 and 31 overlap each other intercepts light, while the other sections where no overlapping takes place transmit light in a quantity sufficient to eliminate the electric charge on the photosensitive body.

In the following, an explanation will be given of a mechanism for selecting the necessary image region (hereinafter referred to as "monitoring mechanism").

FIG. 1 shows one embodiment of the electrophotographic reproduction apparatus having the monitoring mechanism. This monitoring mechanism is constructed with an illuminating lamps 38, a lens 39, reflecting mirrors 40, 41, a screen 42, indexes $X_1$, $X_2$, $Y_1$ and $Y_2$. When the image original placing table 3, on which the image original 4 is mounted, is positioned above the illuminating lamps 38, the illuminated image is projected on the screen 42 through an optical system consisting of the lens 39, and the reflecting mirrors 40, 41. The necessary image region for reproduction is selected from this image on the screen 42 by means of the indexes $X_1$, $X_2$, $Y_1$ and $Y_2$. Of these indexes, $X_1$ and $X_2$ are to select a length of the necessary image region (a length of betwen a and d, or b and c in FIG. 4). The position signals selected by the abovementioned indexes $X_1$ and $X_2$ are transmitted to the control means for controlling up-and-down movement of the polarizing plates in FIG. 5. The indexes $Y_1$ and $Y_2$ are to select a width of the necessary image region (a width of between a and b, or d and c in FIG. 4). The position signals of the width of the abovementioned necessary image region selected by the indexes $Y_1$ and $Y_2$ are transmitted to the control means for setting the overlapping position of the polarizing plates.

Figure 7:
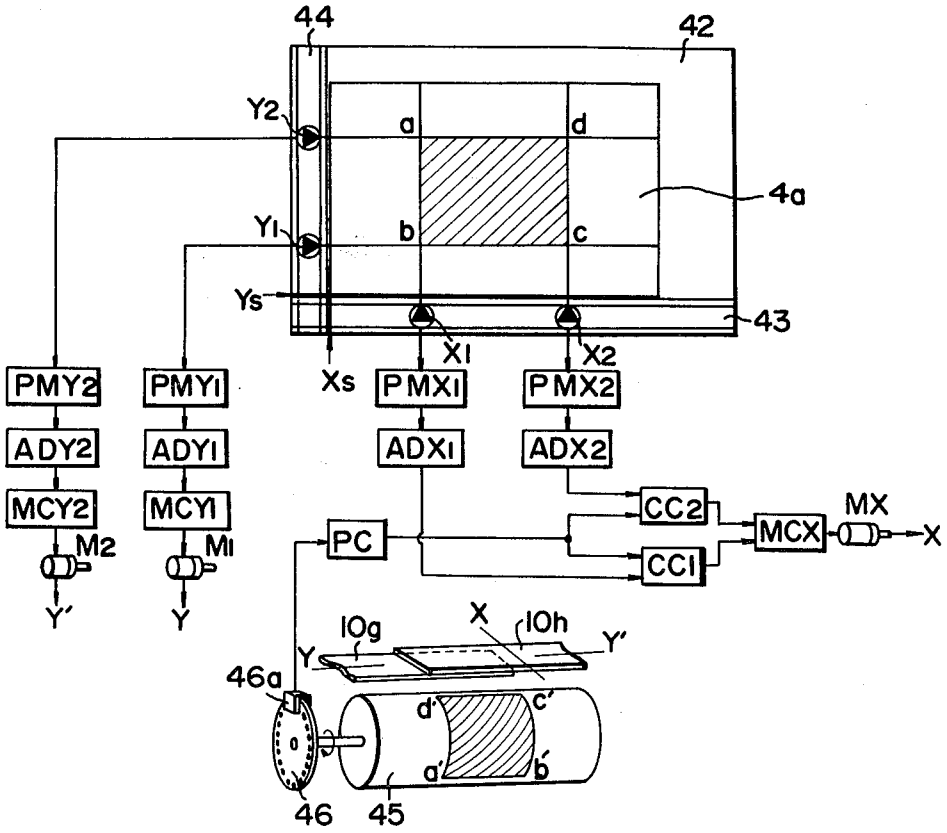
FIG. 7 is an explanatory diagram of the positioning means in the monitoring mechanism.

In the following, detailed explanations will be given in reference to a preferred embodiment as to the positioning means to select the necessary image region. In FIG. 7, the necessary image region (a hatch line area enclosed by a-b-c-d) of the projected image 4*a* in the image original 4 on the screen 42 is selected by indexing buttons $X_1$, $X_2$, $Y_1$ and $Y_2$ which can be arbitrarily moved on the indexing rails 43 and 44. The position signal of the indexing button $X_1$ to select the length (between a and d) of the necessary image region is detected by a potentiometer $PMX_1$ in terms of a voltage drop value or a resistance value from a reference line Xs on the indexing rail 43, is converted into a digital signal by an AD converter $ADX_1$, and forwarded to a coincidence circuit $CC_1$. On the other hand, a signal for the rotational position of the abovementioned photosensitive body 45, which has been detected from a clock plate 46 rotating in the arrow direction in synchronism with the drumshaped photosensitive body 45 by an optical or magnetic device 46*a* as a clock pulse, is also forwarded to the abovementioned coincidence circuit $CC_1$ through a pulse counter PC. In this coincidence circuit $CC_1$, the position signal of the photosensitive body 45 is compared with the position signal by the previous indexing button $X_1$. When both are coincided, a signal is sent to a motor control circuit MCX. By this signal, the motor control circuit MCX is actuated to drive the motor Mx and the polarizing plates 10*g* and 10*h* are moved in the direction of the axis X. In the same manner, the position signal of the indexing button $X_2$ is forwarded to a coincidence circuit $CC_2$ through a potentiometer $PMX_2$, and an AD converter $ADX_2$. When the abovementioned signal coincides with a signal from the clock plate 46, the motor Mx is actuated to move the polarizing plates 10*g* and 10*h* to a predetermined position in the direction of the axis X.

On the other hand, the position signal of the indexing button $Y_1$ for selecting the width of the necessary image region (a-b) is detected by a potentiometer $PMY_1$ in terms of a voltage drop value or a resistance value from the reference line Ys on the indexing rail 44, and is converted into a digital signal by an AD converter $ADY_1$. This digital signal is further sent to a motor control circuit $MCY_1$ and is converted into a pulse to actuate a pulse motor $M_1$. As the result, the polarizing plate 10*g* is moved by the pulse motor $M_1$ to a predetermined position in the direction of the axis Y. In the same manner, the position signal of the indexing button $Y_2$ actuates a pulse motor $M_2$ through a potentiometer $PMY_2$, an AD converter $ADY_2$, and a motor control circuit $MCY_2$ to move the polarizing plate 10*h* in the direction of the axis Y'.

In the above-described manner, there can be formed an electrostatic latent image (a'-b'-c'-d') on the photosensitive body 45 corresponding to the necessary image region (a-b-c-d). Incidentally, the pulse motors $M_1$ and $M_2$ respectively correspond to the motors 30 and 37 in FIG. 6.

In the following, explanations will be given in reference to other embodiments than that shown in FIGS. 5A to 5H as to movement of the masking members to control the longitudinal direction of the necessary image region.

FIGS. 8A to 8H show other operative embodiment of the polarizing plates as the masking members. The construction of every part of the polarizing plates is the same as that shown in FIGS. 5A to 5H, with the exception that the polarizing plates are mutually movable (in the previous embodiment in FIG. 5, the polarizing plates are of the simultaneous moving type, in which the plates move up and down in their fixedly overlapped stated).

Figure 8A:
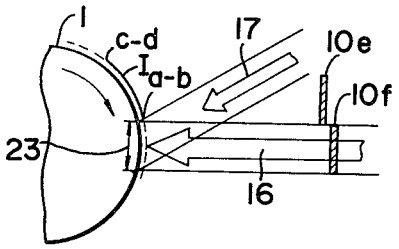
FIGS. 8A through 8H as well as FIGS. 9A to 9H are respectively explanatory diagrams showing the conditions of synchronous movement of the other polarizing plates with the photosensitive body.
Figure 8B:
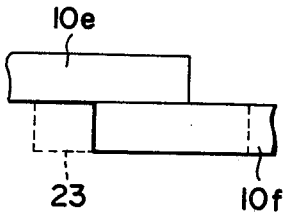
Figure 8C:
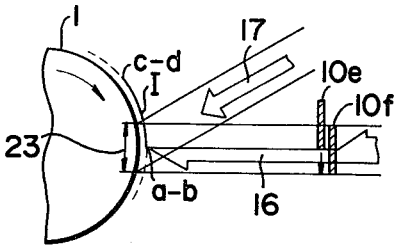
Figure 8D:
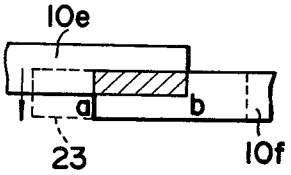
Figure 8E:
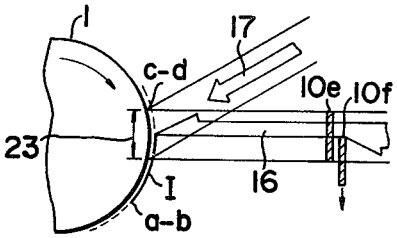
Figure 8F:
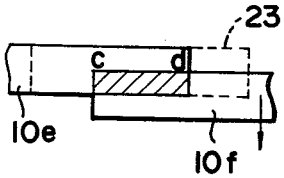
Figure 8G:
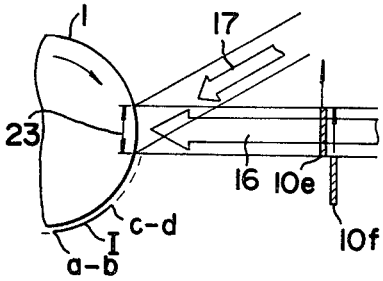
Figure 8H:
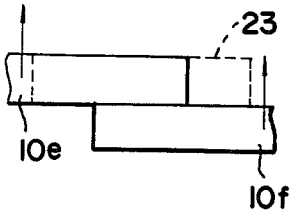

As shown in FIGS. 8A and 8B, one of the polarizing plates (10*e* in this instance) is completely away from the light path of the control light 16 of the image region until the front end position a-b of the necessary image region in the image I to be formed from the image original reaches the irradiating region 23 of the control light 16 of the image region with respect to the exposure light 17. The other polarizing plate (10*f* in this instance), however, is fixed in the light path in a manner to perfectly intercept the control light 16. Next, when the position a-b travels forward and reaches the light irradiating region 23, the bottom end of the polarizing plate 10*e* begins to lower in the arrow direction in synchronism with travelling of the position a-b, as shown in FIGS. 8C and 8D. Subsequently, the polarizing plate 10*e* continues to lower until it perfectly overlaps with the other polarizing plate 10*f* and the light irradiating region 23, and stops. This state is maintained until the rear end position c-d of the necessary image region in the image I reaches the light irradiating region 23. When the position c-d arrives at the light irradiating region 23, the polarizing plate 10*e* stays on the light path of the control light 16, and the top end of the polarizing plate 10*f* begins to lower in the arrow direction in synchronism with travelling of the position c-d, as shown in FIGS. 8E and 8F. Finally, the polarizing plate 10*f* is perfectly away from the light path of the control light 16, and stops. This state is maintained until the image original scanning operation terminates, after which the polarizing plates 10*e* and 10*f* rise upward in the arrow distance as shown in FIGS. 8G and 8H to return to their original positions in FIGS. 8A and 8B.

It will be understood from the above that, same as the operative embodiment shown in FIGS. 5A and 5B, a reproduced image with the surrounding image region in the image original as shown in FIG. 4 can be finally obtained. In this particular embodiment of the polarizing plate unit, since the two polarizing plates need not be moved simultaneously, the synchronism between the end part of the polarizing plate and the travelling of the image I can be easily taken. It may be possible that the polarizing plate 10*e* and 10*f* be operated in the opposite sequence as mentioned in the foregoing.

Figure 9A:
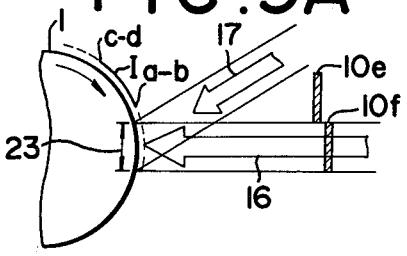
Figure 9B:
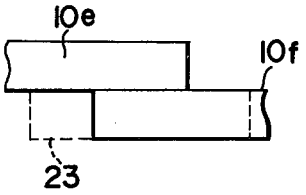
Figure 9C:
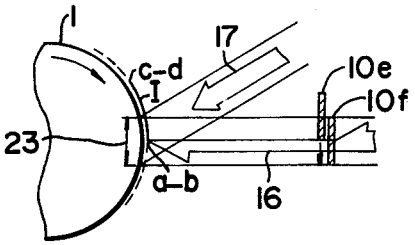
Figure 9D:
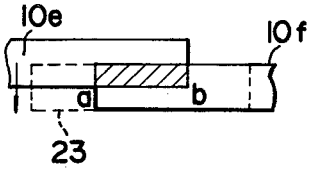
Figure 9E:
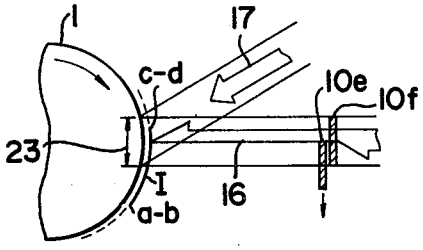
Figure 9F:
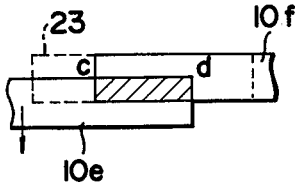
Figure 9G:
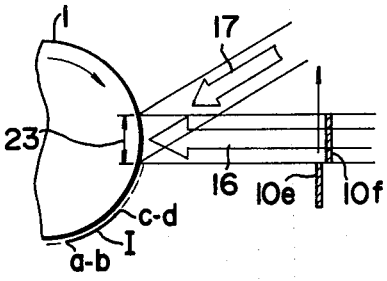
Figure 9H:
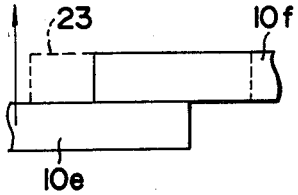

FIGS. 9A and 9H illustrate still other operative embodiment of the polarizing plate, wherein the construction of each part is the same as that shown in FIGS. 5A to 5H and 8A to 8H. In this embodiment, one of the polarizing plates is constantly fixed in the light path of the control light 16 of the image region, and the other polarizing plate alone moves.

In FIGS. 9A to 9H, the polarizing plate 10*f* is fixed in the light path of the control light 16 from the image region so as to constantly and perfectly intercept the control light. As shown in FIGS. 9A and 9B, the polarizing plate 10*e* is perfectly away from the light path of the control light 16 until the position a-b at the front end of the necessary image region in the image I to be formed from the image original reaches the irradiating region 23 of the control light 16 with respect to the exposure light 17. Next, when the position a-b travels forward and arrives at the light irradiating region 23, the bottom end of the polarizing plate 10*e* begins to lower in the arrow direction in synchronism with travelling of the position a-b. Subsequently, the polarizing plate 10*e* continues to lower until it perfectly overlaps with the other polarizing plate 10*f* in a fixed position and the light irradiating region 23, and stops. This state is maintained until the rear end position c-d of the necessary image region in the image I arrives at the light irradiating region 23. When the abovementioned position c-d reaches the light irradiating region 23, the top end of the polarizing plate 10*e* begins to lower in the arrow direction in synchronism with the travelling of the position c-d, as shown in FIGS. 9E and 9F. Finally, the polarizing plate 10*e* is perfectly away from the light path of the control light 16, and stops. This state is maintained until the scanning operation of the image original terminates, after which the polarizing plate 10*e* rises up in the arrow direction as shown in FIGS. 9G and 9H to return to its original position in FIGS. 9A and 9B.

From the above explanations, it is possible to obtain only the desired image region for the image original except for its surrounding part as shown in FIG. 4, in the same manner as in the operative embodiments of FIGS. 5A to 5H and 8A to 8H. Further, in this particular embodiment, since one of the polarizing plates along moves, the construction of the polarizing plate moving control means can be made simple. It is to be noted that the polarizing plate 10*e* be fixed and the polarizing plate 10*f* be moved just in opposite to the abovementioned explanations.

In the following, a method for reproducing an image in the form just opposite to that shown in FIG. 4 will be explained.

Figure 10:
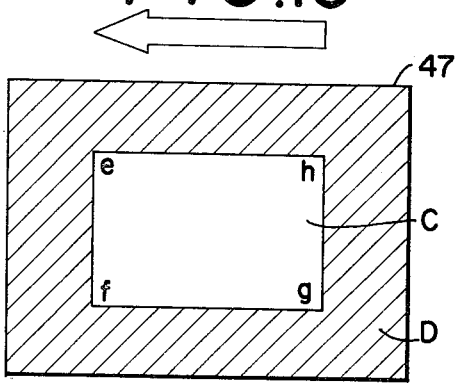
FIG. 10 is an explanatory diagram for a necessary image region D for reproduction, opposite to that in FIG. 4.

FIG. 10 shows an image original 47, in which an unnecessary image region C enclosed by e-f-g-h and a necessary image region D surrounding this unnecessary image region C and indicated by diagonally hatched lines are coexistent. The image original 47 travels in the direction of an arrow, and sequentially scanned with a predetermined slit-exposure width. In the illustration, a position e-f (or h-g) corresponds to the width of the unnecesssary image region C, and a position e-h (or f-g) corresponds to the length thereof.

Figure 11A:
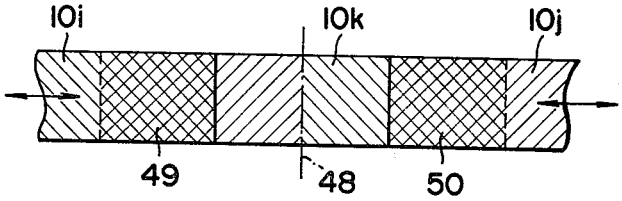
FIG. 11A is an explanatory diagram showing one example of overlapping of three polarizing plates.
Figure 11B:
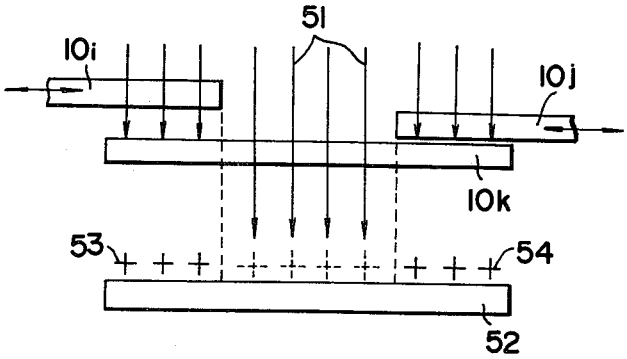
FIG. 11B is a schematic explanatory diagram for an electrostatic latent image formation using the abovementioned polarizing plates.

FIGS. 11A and 11B shows a way, in which the polarizing plates are overlapped to obtain the necessary image region D as shown in FIG. 10.

In FIG. 11A, the polarizing plates 10*i* and 10*j* are so constructed that the polarizing directions thereof may be orthogonally intersected. Further, a polarizing plate 10*k* is so constructed that its polarizing direction may be orthogonally intersected with the polarizing plates 10*i* and 10*j*, respectively. For example, if the diagonal lines in the drawing are taken as the polarizing direction of the plate, the polarizing plates 10*i* and 10*k*, 10*j* and 10*k*, and 10*i* and 10*j* are mutually orthogonal in their polarizing direction. In other words, the left and right sides of the polarizing plate 10*k* as divided by a dot-and-dash line 48 as the center have mutually different polarizing directions (i.e. orthogonally intersected direction). In the drawing, criss-crossed sections 49 and 50 denote the overlapped portions of the polarizing plates 10*i* and 10*k*, and 10*j* and 10*k*, respectively.

FIG. 11B illustrates an example of forming an electrostatic latent image of an arbitrary image region on the photosensitive body based on the principle of the present invention. The drawing shows the way, in which the polarizing plates 10*i*, 10*j* and 10*k* are mutually overlapped, as viewed from the top of the FIG. 11A. Same as in the example of FIG. 3B, the overlapped portion of the polarizing plates 10*i* and 10*k* or 10*j* and 10*k* either perfectly intercepts the control light 51 from the image region, or intercepts it to such an extent that at least the electric charge on the surface of the photosensitive body may be not be eliminated. On the other hand, the single portion of the polarizing plate 10*k* which does not overlap with other polarizing plate permits passage of the control light 51 in a quantity sufficient perfectly eliminate the electric charge. Accordingly, as shown in the drawing, there remain electrostatic latent images 53, 54 (shown with positive (+) charge) only the light-intercepted portions of the photosensitive body, and the electrostatic latent image at the portion on the photosensitive body where the control light 51 is transmitted is completely eliminated.

In the following, operative embodiment of the polarizing plates for obtaining the necessary image region D as shown in FIG. 10 will be explained.

Of the 3-polarizing-plate-structure as shown in FIGS. 11A and 11B, when the polarizing plates 10*i* and 10*j* are considered to be a set, it is possible to operate this polarizing plate unit in the same manner as in the operative embodiments of the two-polarizing-plate-structure as shown in FIGS. 5A to 5H, 8A to 8H, or 9A to 9H. In other words, the set of the polarizing plates 10*i* and 10*j* and the polarizing plate lok can be: (1) simultaneously moved up and down as in the example of FIGS. 5A to 5H; (2) alternately moved as in the examples of FIGS. 8A to 8H; and (3) only one of is moved while the other is fixed in the light path of the control light from the image region as in the example of FIGS. 9A to 9H. Incidentally, in the case of leaving the entire image area in the image original from the front end to the position e-f, and from the position h-g to the rear end thereof, it is sufficient if the abovementioned control light is intercepted by a light intercepting member such as a frame of a polarizing plate unit.

Further, in the case of making the polarizing plates 10*i* and 10*j* in FIGS. 11A and 11B correspond to the polarizing plates 10*e* and 10*f* in FIGS. 5A to 5H, if the image as shown in FIG. 4 where a partial image region in the image original is to be left for reproduction, the polarizing plates 10*i* (10*e*) and 10*j* (10*f*) may be operated as shown in FIGS. 5A to 5H, and, if the image as shown in FIG. 10 where the image region at the center part of the image original is to be eliminated, the polarizing plate 10*k* having the abovementioned light intercepting member may be added and operated together with the polarizing plates 10*i* (10*e*) and 10*j* (10*f*) in the same manner as in the example of FIG. 5A to 5H, whereby the simultaneous movement type of the polarizing plate with three-plate-structure can be realized. In other words, depending on whether an additional polarizing plate is incorporated in the polarizing plate unit of the same construction, or not, it becomes possible to either leave a part of the image region in the image original or eliminate the same image region, so that a wide range of controls for the image formation can be realized by a simple combination of the polarizing plates.

In FIGS. 11A and 11B, it is also possible to construct the polarizing plates in such a manner that the polarizing direction of the plates 10*i* and 10*j* is the same, and that of the polarizing plate 10*k* in its entirety is made perpendicular to the polarizing direction of the polarizing plates 10*i* and 10*j*. Also, in FIG. 11B, the electrostatic latent images 53 and 54 can be obtained on the photosensitive body 52, even when the polarizing plate 10*i* is disposed in contiguity to the polarizing plate 10*k* as is the case with the plate 10*j*.

In the foregoing, explanations have been given in detail about the actual example of the method for forming an image, in which only the necessary image region is obtained by eliminating the electric charge of the unnecessary image region on the photosensitive body. In those instances, the control light of the image region on the photosensitive body, from which the electric charge is to be eliminated, is irradiated on the photosensitive body simultaneously with the exposure light of the image original. The control light, however, is not necessary to be irradiated simultaneously with the exposure light. That is to say, during the electrostatic latent image forming step to be effected simultaneously with or after the primary charging, but prior to the image development, the abovementioned control light may be irradiated either before the exposure position on the photosensitive body, or after the exposure position. When the photosensitive body of the three-layer structure having an electrically conductive layer, a photoconductive layer, and an insulating layer, as described in U.S. Pat. No. 3,666,363 is used for the electrophotographic reproduction, it is desirable that the control light be irradiated simultaneously with the exposure light of the image original on the photosensitive body. The same result can also be obtained, if the irradation by the control light is conducted at a position before the exposure position on the photosensitive body only during a time period where the light-irradiated photoconductive layer maintains its electrical conductivity.

Furthermore, in the electrophotographic process using the abovementioned three-layered photosensitive body, when the control light is irradiated after the exposure position, the following effect can be obtained.

Figure 12:
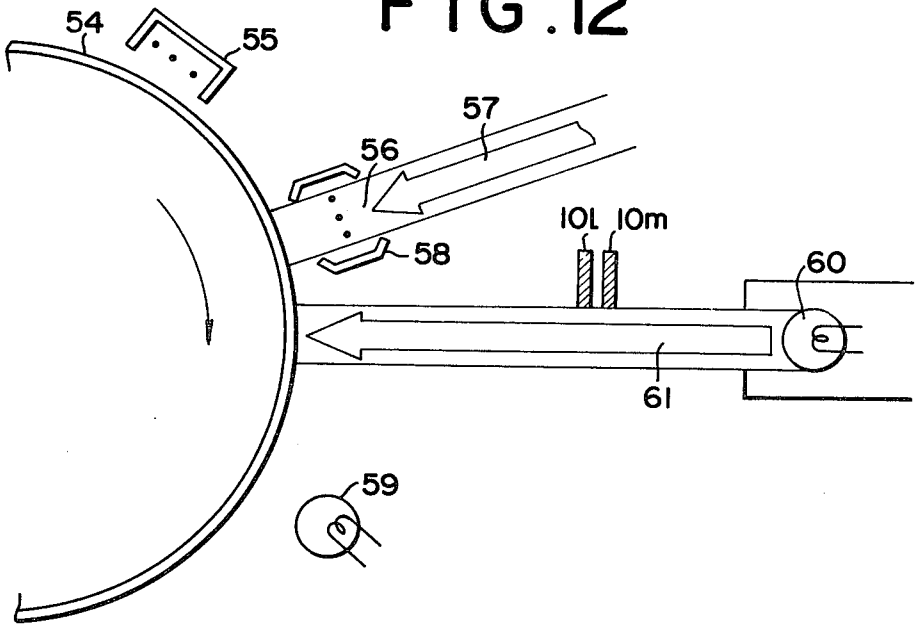
FIG. 12 is a schematic diagram to explain the control step of the image region, when a three-layered photosensitive body is used.

FIG. 12 illustrates an example of forming an electrostatic latent image, when the three-layered photosensitive body consisting of the electrically conductive layer, the photoconductive layer, and the surface insulating layer is utilized. In the drawing, the drum-shaped photosensitive body 54 of the three-layered structure is first charged positively by a corona discharger 55 in the positive polarity. When it subsequently reaches the exposure section 56, it is subjected to removal of AC charge by an AC corona discharger 58 simultaneously with the exposure light 57 of the image original. Thereafter, the overall exposure is carried out by an overall exposure light source 59, whereby the electrostatic latent image is formed on the surface of the photosensitive body 54.

The embodiment in this FIG. 12 is to inhibit formation of the electrostatic latent image of the unnecessary image region by controlling the overall exposure region at the time of the overall exposure operation.

In the drawing, a light source 60 for controlling the image region is to irradiate the control light 61 of the image region on the photosensitive body 54, which plays a part of the overall exposure in place of the overall exposure light source 59. As shown, polarizing plates 10*l* and 10*m* are controlled their overlapping position as mentioned above, and move across the light path of the control light 61 like the polarizing plates shown in FIGS. 5A to 5H, 8A to 8H, and 9A to 9H. By the light-intercepting function of these polarizing plates, the electrostatic latent image formation can be controlled in the same manner as the method of eliminating the electric charge on the photosensitive body. It should, however, be noted that the results of electrostatic latent image formation are different between the method of controlling the overall exposure and the method of eliminating the electric charge as mentioned in the foregoing. The electrostatic latent image formation by the method of controlling the overall exposure will now be explained in detail.

Figure 13:
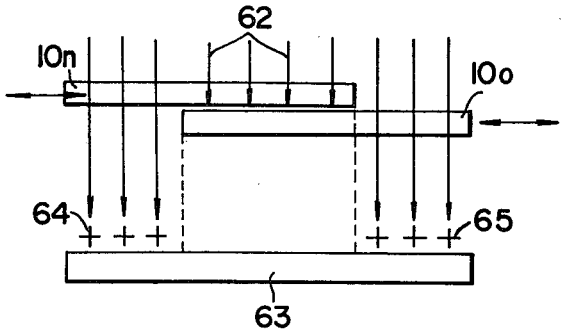
FIG. 13 is an explanatory diagram for an electrostatic latent image formation, when two polarizing plates are used at the time of overall exposure.

FIG. 13 illustrates an example of forming the electrostatic latent image only in an arbitrary region on the three-layered photosensitive body at the time of the overall exposure in accordance with the principle of the present invention to control the control light in the image region by overlapping the polarizing plates as mentioned above.

Figure 14:
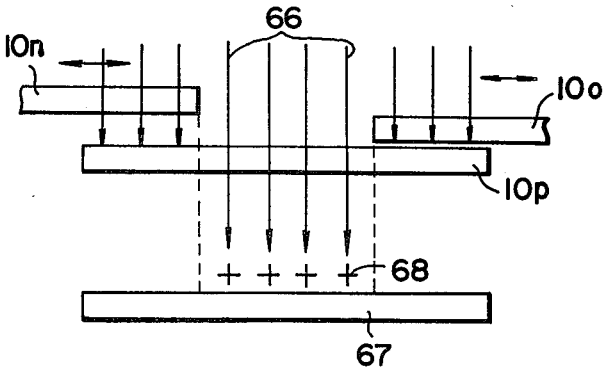
FIG. 14 is an explanatory diagram for an electrostatic latent image formation, when three polarizing plates are used at the time of overall exposure.

In the drawing, the control light 62 in the image region is intercepted at a portion where the polarizing plates 10*n* and 10*o* are overlapped, and is allowed to pass at a portion where the polarizing plate remains single without overlapping with the other. In the electrostatic latent image forming process on the three-layered photosensitive body, there is created an electrostatic contrast by irradiation of light onto the photosensitive body after the simultaneous AC charge removal and exposure, whereby the electrostatic latent image is formed. Accordingly, as shown in the drawing, the portion on the three-layered photosensitive body 63 where the light is intercepted does not form the electrostatic latent image, but only the portion where the control light 62 is irradiated forms the electrostatic latent images 64, 65 (shown by positive electric charge). Further, as shown in FIG. 14, when a polarizing plate 10*p* is added to the polarizing plates 10*n* and 10*o* in FIG. 13 and overlapped with them, there is formed an electrostatic latent image 68 only on the portion of the photosensitive body 67 where the control light 66 from the image region has been irradiated, in the form opposite to that of the latent images 64 and 65 in FIG. 13. As will be apparent from comparison of FIG. 13 and FIG. 3B as well as FIG. 14 and FIG. 11B, the formed pattern of the electrostatic latent image is totally different between the method of controlling the overall exposure (FIGS. 13 and 14) and the method of eliminating the electric charge (FIGS. 3B and 11B), in spite of the fact that the polarizing plates of the same construction are used. This signifies that the same result may be obtained when the abovementioned two methods are used in combination in view of the foregoing cases of leaving a part of the image region in the image original and eliminating the same portion by adding one polarizing plate to the existing polarizing plates, or not.

Figure 15:
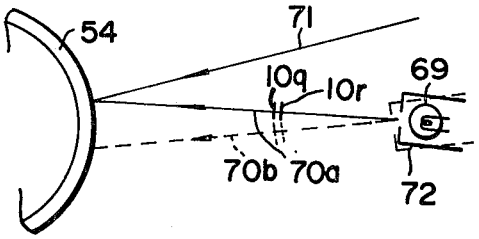
FIG. 15 is a schematic explanatory diagram showing selection of an image forming region by changing the light irradiating position.

FIG. 15 illustrate an example of a method, wherein a selected image region is left out or eliminated by changing the irradiating position of the control light from the image region to the three-layered photosensitive body. When the image region B as shown in FIG. 4 is to be obtained, a control light 70*a* from the image region irradiated by the light source 69 for controlling the image region and controlled by the polarizing plates 10*q* and 10*r* in two-plate structure is irradiated to the photosensitive body 54 simultaneously with exposure light of the image original to thereby eliminate the electric charge of the unnecessary image region on the photosensitive body. When the image region D as shown in FIG. 10 which is totally opposite to the image region B in FIG. 4 is to obtained, the irradiating direction of the control light 70*a* is changed to the arrow direction 70*b* shown in a dot line, and this control light 70*b* is intercepted by overlapping of the polarizing plates 10*q* and 10*r* to inhibit formation of the electrostatic latent image on the photosensitive body 54. By this, the image forming region can be selected without changing the structure of the polarizing plates.

In FIG. 15, it is also possible to use the polarizing plates of the three-plate structure as in FIG. 14, i.e., polarizing plates 10*n*, 10*o* and 10*p*. In this case, exactly same result can be obtained as in the abovementioned example with the exception that the image formed is just opposite due to irradiation direction of the control light. Further, when a slit 72 of the light source frame in FIG. 15 is set in a freely openable and closable manner as a shutter mechanism, there is no necessity for moving the polarizing plate across the control light of the image region in synchronism with travelling of the image original. In other words, when the control light is irradiated on the photosensitive body simultaneously with the exposure light of the image original, the polarizing plate is fixed in a manner to intervept the control light, and the slit is kept closed until the image original shown in FIG. 10 is scanned and reaches the position e-f. When the scanning of the image original arrives at the position e-f, the slit is opened. This state is maintained until the scanning of the image original reaches the position h-g, when the slit is again closed. Accordingly, no control light of the image region is irradiated at all in the image region from the tip end of the image original to the position e-f and from the position h-g to the rear end of the image original due to the slit being kept closed, hence the portions remain as the necessary image region for reproduction. On the other hand, the control light is irradiated on the photosensitive body on the image region from the position e-f to the position h-g through the polarizing plates of three-plate structure, and the electric charge on the photosensitive body corresponding to the image region C enclosed by e-f-g-h in FIG. 10 is totally eliminated. As the result, no reproduction image is formed in this region. Also, when control light of the image region is irradiated on the photosensitive body in the dotted line direction 70*b* in FIG. 15 by changing its direction of irradiation, there can be obtained an image just opposite to that shown in FIG. 4. According to this method, the lengthwise direction of the necessary image can be controlled without moving the polarizing plate whatsoever in the light path of the control light, hence the control means can be made simple in construction. However, when the shutter is opened and closed, the quantity of light to be irradiated on the photosensitive body is reduced with the result that the boundary section between the image region and the non-image region is liable to be ambiguous. In contrast to this, when the masking member is moved in synchronism with travelling of the photosensitive body, the bundary section of the reproduced image can be made very clear.

In place of the polarizing plates in three-plate structure as in FIG. 11, it is possible to use a light intercepting member having a predetermined controllable opening width to cause it to move across the light path of the control light in synchronism with travelling of the photosensitive body. By controlling the opening width of this light intercepting member, there can be obtained an electrostatic latent image as shown in FIG. 11B or 14 as is the case with the polarizing plate of the three-plate structure. Accordingly, when the light intercepting member is disposed on the position of the polarizing plate in FIG. 15, the formation of the same image as with the polarizing plate of the three-plate structure becomes possible.

In the foregoing explanations, the present invention has been described in reference to the so-called Carlson process using a two-layered photosensitive body and the electrophotographic method using a three-layered photosensitive body. It may be easily understood that the present invention is, of course, applicable to other processes or devices, or other processes or devices using photosensitive paper.

Figure 16:
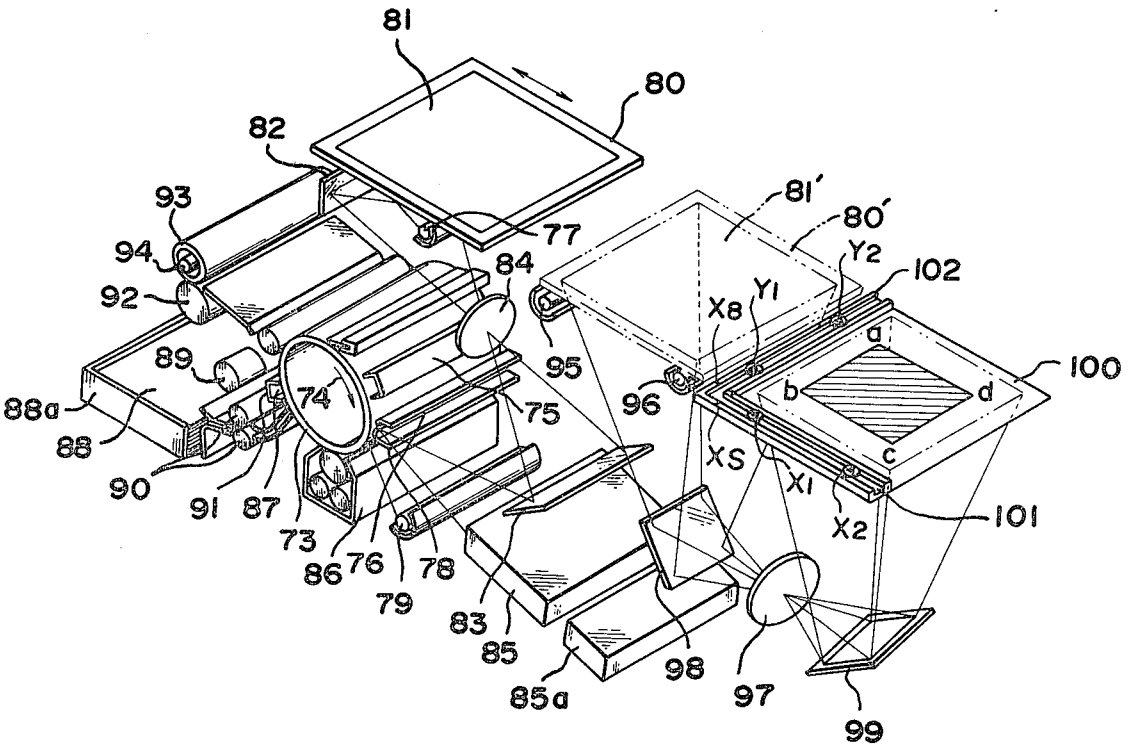
FIG. 16 is a perspective view showing one embodiment of the electrophotographic reproduction apparatus, to which the present invention is applied.

In the following, explanations will be made as to a more concrete embodiment of the present invention, in which the control mechanism of the image forming region is applied to a reproduction apparatus. In FIG. 16, a reference numeral 73 designates a drum-shaped photosensitive body. As one example, the drum-shaped photosensitive body is such one as used in the latent image forming step described in the aforementioned U.S. Pat. No. 3,666,363. The photosensitive body 73 is composed of a three-layered structure having a photoconductive layer consisting of CdS. Upon a copying operation instruction, the photosensitive drum 73 starts rotation in the direction of an arrow 74 in the drawing. After it is positively charged by a primary charger 75, an image original irradiated by an illuminating lamp 77 is slit-exposed thereon at an exposure section 76.

Simultaneously with this slit-exposure, a charge removing operation is carried out by an a.c. corona discharger 78. Thereafter, an overall exposure operation is conducted by an overall exposure lamp 79, whereby an electrostatic latent image having a high electrostatic contrast is formed on the photosensitive body 73. On the other hand, an image original 81 on an image original placing table 80 is illuminated by the illuminating lamp 77 from beneath, the illuminated image of which is focused on the photosensitive body 73 through an optical system consisting of reflecting mirrors 82, 83 and a lens 84, and an electrostatic latent image is formed on the photosensitive body. In this instance, since the image forming region is controlled by eliminating the electrostatic latent image of the unnecessary image region on the photosensitive body 73, the control light of the image region is irradiated by a light source frame 85*a*, and the control light is controlled in accordance with the overlapped section of the masking members in the control device 85, whereby the electrostatic latent image of the unnecessary image region on the photosensitive body 73 is eliminated. The electrostatic latent image of the necessary image region on the photosensitive body 73 thus formed by eliminating the electrostatic latent image of the unnecessary image region is subsequently developed by a developer 86, and the developed image is transferred to an image transfer paper 88 at an image transfer section 87. The image transfer paper 88 is stored in a cassette 88*a*, fed into the reproduction apparatus through paper feeding roller 89, and forwarded to the image transfer section 87 with a predetermined timing being taken by register rollers 90 for the abovementioned developed image. At the image transfer section 87, the developed image on the photosensitive drum 73 is transferred to the image transfer paper 88 by electric discharge from an image transfer corona discharger 91. After the image transfer, the image transfer paper 88 is separated from the photosensitive drum 73 by a separating device (not shown). Thereafter, the image transfer paper 88 is guided to image fixing rollers 92, 93, and, during its passage through the rollers, the image transfer paper is subjected to pressure by the rollers and to heat from a heater provided in the roller to thereby fix the image transferred thereonto. After the image fixing, the image transfer paper is discharged outside the reproduction apparatus.

In FIG. 16, reference numerals 95 through 102 and reference symbols $X_1$, $X_2$, $Y_1$ and $Y_2$ designate component parts to constitute the monitoring mechanism for selecting the necessary image region in the image original, which is the same as those shown in FIGS. 1 and 7, wherein 95 and 96 refers to illuminating lamps for monitoring, 97 a lens, 98 and 99 reflecting mirrors, 100 a screen of the monitor, $X_1$, $X_2$, $Y_1$ and $Y_2$ indexing buttons to select the necessary image region (diagonally hatched portion enclosed by a-b-c-d), and 101 and 102 indexing rails, along which the indexing buttons move.

In the following, explanations will be given, in reference to FIG. 17, as to the control device 85 of the image forming region in the electrophotographic reproduction apparatus shown in FIG. 16.

Figure 17:
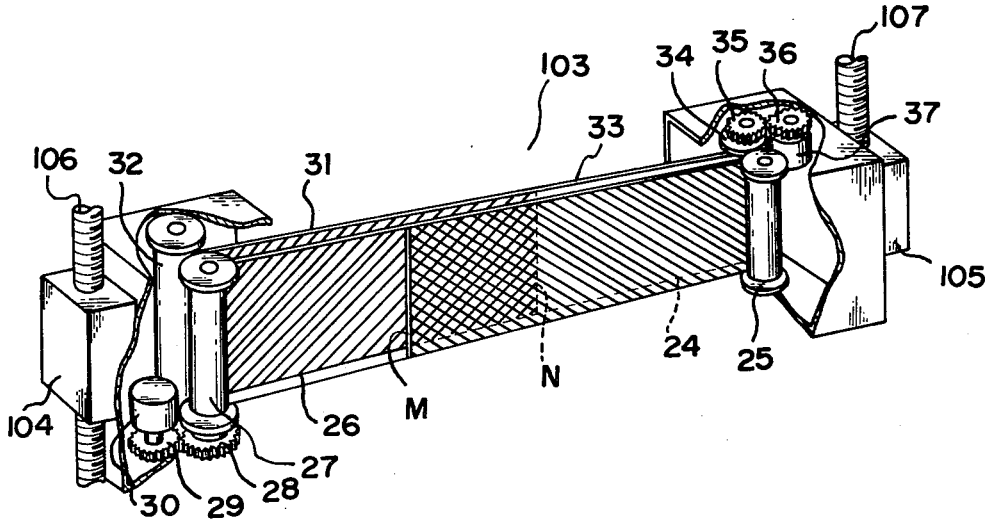
FIG. 17 is a perspective view showing one embodiment of the polarizing plate unit which moves in synchronism with travelling of the photosensitive body.

FIG. 17 is a perspective view showing one embodiment of the polarizing plate unit 103 as the control device for the image forming region, in which the same parts as those shown in FIG. 6 are designated by the same reference numerals and symbols. As has been clearly described with respect to FIG. 6, the polarizing plates 24 and 31 are able to vary their overlapping degree by the illustrated mechanism. Ball screws 104 and 105 are fixedly provided on the casings at both left and right sides of the polarizing plate unit 103, into which threaded screws 106 and 107 are engaged. By rotating these screws 106 and 107 by the motor Mx, the entire polarizing plate unit can be moved up and down in synchronism with travelling of the photosensitive body. It will be readily understood that, besides using the ball screws and the threaded screws, the polarizing plate unit can be synchronously moved by other means such as wire and pulley, and other equivalent expedients.

Figure 18:
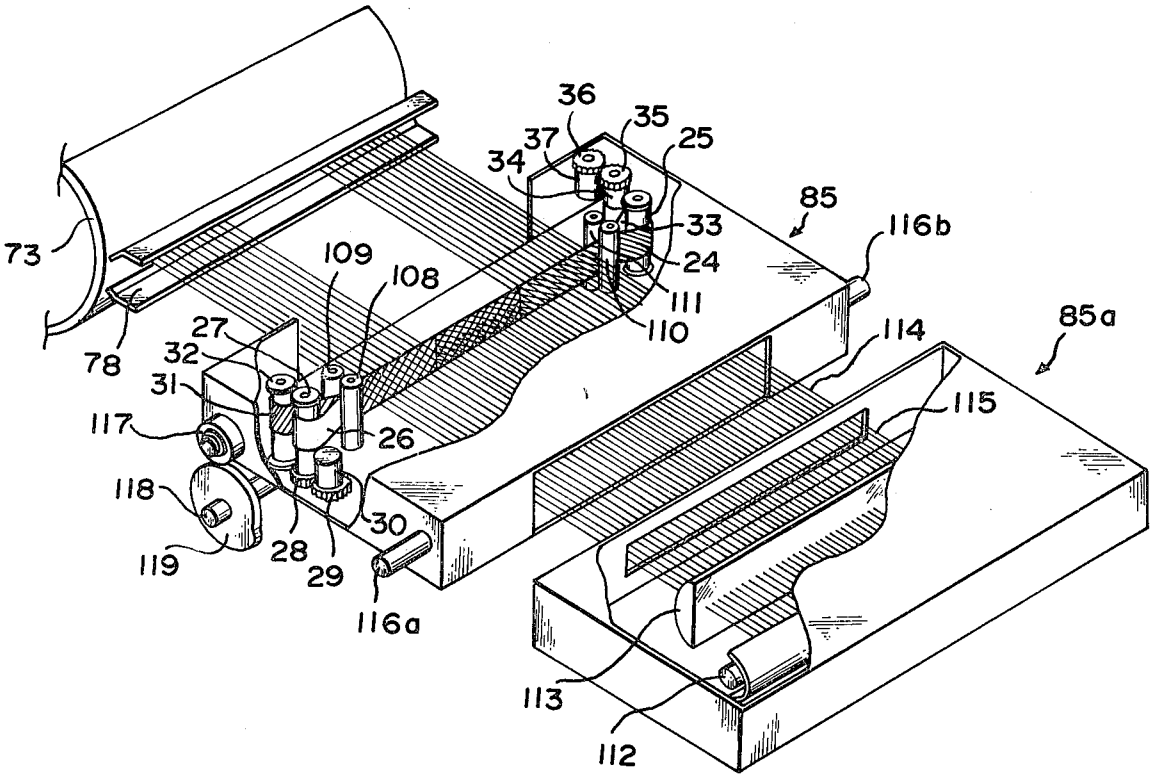
FIG. 18 is a perspective view showing another embodiment of the polarizing plate unit (control device)

Referring now to FIG. 18, the synchronous movement of the control device for the image forming region will be described more concretely.

FIG. 18 is a perspective view of one embodiment of the control unit 85 shown in FIG. 16, in which the abovementioned control unit is synchronized with travelling of the photosensitive body using the main part of the polarizing plate unit shown in FIGS. 6 and 17. In the drawing, reference numerals 108, 109 and 110, 111 are respectively a pair of rollers provided in a freely rotatable manner to move the polarizing plates 24, 31 in contiguity thereto, or in contact therewith. The light source frame 85*a* to accommodate the light source 112 and the cylindrical lens 113 therein is fixedly provided on the main body of the apparatus. The control light 114 to control the image region to be irradiated onto the photosensitive body 73 from the light source 112 is rendered uniform by means of the cylindrical lens 113, and reaches the polarizing plates 24, 31 within the control device 85 through the slit opening 115 which regulates a width of the exposure light. As stated previously, the control light 114 is intercepted at a portion where the polarizing plate 24 and 31 are overlapped (M-N in FIG. 18), while it passes through the plate at both ends where they are not overlapped, thereby eliminating the electric charge on the photosensitive body 73. When the slit exposure width is regulated at the opening section of the simultaneous exposure corona discharger, there is no necessity for regulating the exposure width with the opening 115 of the light source frame.

At both ends near the light source 112 of the control device 85, there are provided shafts 116*a* and 116*b* which are pivotally supported on the main body of the reproduction apparatus. Also, at one end of the control device at the said opposite to and away from the light source, there is provided a cam follower 117 in a freely rotatable manner. The cam follower 117 is engaged with a cam 119 fixed on a cam shaft 118 beneath the control device 85. By rotation of this cam 119, the control device 85 oscillates in the up and down direction with the shafts 116*a* and 116*b* as the pivot. As the consequence, the polarizing plates 24, 31 moves up and down in a manner to cross the light path of the control light 114 of the image region as the polarizing plates 10*e* and 10*f* shown in FIGS. 5A to 5H showing the operative principle thereof.

In the following, the operations of the cam 119 will be explained in reference to FIG. 7 which shows one embodiment of the monitoring mechanism and to FIGS. 5A to 5H which show the principle of the synchronous moving operation of the polarizing plates.

Figure 19:
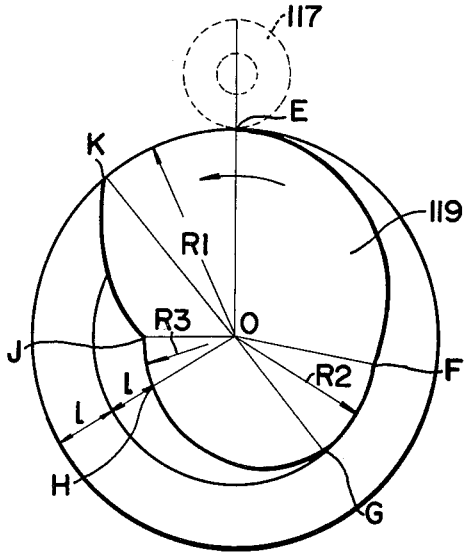
FIG. 19 is a side view of one embodiment of the cam used in the control device shown in FIG. 8.

FIG. 19 explains one embodiment of the cam which is so formed as the completing one synchronous moving operation by its single revolution. In the drawing, the cam follower 117 contacts with the cam 119 at a point E, and the cam follower 117 stays at this point E until the position of the front end a-b of the image I in FIGS. 5A and 5B arrives at the light irradiating region 23. When the position of the front end a-b of the image I reaches the light irradiating region 23, a signal from the indexing button $X_1$ shown in FIG. 7 coincides with a pulse number from the clock plate 46, whereby the motor Mx starts its rotation, and the cam 119 coupled with this motor Mx is so controlled that it starts rotation in the arrow direction in FIG. 19, rotates upto the point E, and stop there. The cam follower 117 moves relatively downward in the drawing, while it is following the curve E-F of the cam 119. Accordingly, the bottom ends of the polarizing plates 10*e* and 10*f* in FIGS. 5A to 5H move downward in synchronism with travelling of the photosensitive body in a manner to cross the light path of the control light as shown in FIGS. 5C and 5D. When the cam follower 117 reaches a point F, the polarizing plates 10*e* and 10*f* perfectly intercept the control light 16, and remains in such complete light intercepting state while the cam follower 117 follows the curve F-G of the cam 119 to be represented by an arc having a radius $R_2$, and even after its stoppage at a point G.

When the image original is further scanned, and the position c-d at the rear end of the necessary image region in the image I shown in FIGS. 5C and 5D arrives at the light irradiating region 23, a signal from the indexing button $X_2$ in FIG. 7 coincides with a pulse number from the clock plate 46 to actuate the motor Mx, whereby the cam 119 starts its rotation again, and the cam follower 117 relatively moves to a point J to stop there. The top ends of polarizing plates 10*e* and 10*f* move downward as shown in FIGS. 5E and 5F in synchronism with travelling of the rear end position c-d of the image I on the photosensitive body, during the cam follower 117 following the curve G-H of the cam 119. When the cam follower 117 reaches a point H, the polarizing plates 10*e* and 10*f* are completely away from the light path of the control light 16, and they maintain this state while the cam follower 117 follow the curve H-J of the cam 119 represented by an arc of a radius $R_3$, and even after it stops at the point J. As soon as termination of the scanning operation of the image original is detected, the cam 119 begins its rotation again by the operation of the motor Mx, and the cam follower 117 stops at the point E by way of the curve K-E of the cam 119 represented by an arc of a radius of $R_1$. At this time, the polarizing plates 10*e* and 10*f* move upward as shown in FIGS. 5G and 5H, to return to their original positions in FIGS. 5A and 5B.

Of the external profile of the cam 119, the curves E-K, F-G, and H-J are denoted by arcs having radii of $R_1$, $R_2$ and $R_3$, respectively, and these radii mutually have a relationship represented by $R_1-R_2=R_2-R_3=l$. In the embodiments shown in FIGS. 5A to 5H and 8, corresponds to the vertical width of the polarizing plate, and also to the width of the light irradiating region 23. Needless to say, when the vertical width of the polarizing plate is greater than the light irradiating region, the control can be done in such a manner that the top and bottom ends of the polarizing plate may be synchronized with travelling of the photosensitive body. Accordingly, the value and the vertical width of the polarizing plate should at least be made equal.

The shape of the other curves E-F and G-H of the cam 119 is so set as to be synchronized perfectly with travelling of the photosensitive body, when the cam follower 117 relatively moves downward, i.e., when the polarizing plates 24, 31 (10*e*, 10*f*) move downward, while the cam follower 117 moves from the points E to F, or G to H. Since the shape of the curve J-K is irrelevant to travelling of the photosensitive body, it is not particularly limited.

As has so far been explained in detail, according to the present invention, it is possible to obtain a reproduced image having very clear boundary section of the necessary image region B shown in diagonally hatched lines in FIG. 4 or the necessary image region D in FIG. 10 by controlling the overlapping position of the polarizing plate (masking member), and moving such overlapped polarizing plates across the light of the control light of the image region in synchronism with travelling of the photosensitive body.

What we claim is:

1. An image forming method, wherein an electrostatic latent image is formed on a photosensitive body by electric charging and image exposing steps, and the latent image is developed to obtain the image, which comprises the steps of:

(a) maintaining masking means away from the light path of a control light until a first portion of the photosensitive body which corresponds to the front end of a necessary or an unnecessary region of an electrostatic latent image reaches the irradiating region of said control light;

(b) moving the masking means to intercept the light path of the control light in synchronism with the movement of said first portion after it reaches the irradiating region of the control light;

(c) causing said masking means to be kept in its state of perfectly blocking the light path of the control light until a second portion of the photosensitive body which corresponds to the rear end of the necessary or unnecessary electrostatic latent image region arrives at the irradiating region of the control light;

(d) moving the masking means away from the light path of the control light in synchronism with the movement of the second portion after it arrives at the irradiating region of the control light; and (e) returning the masking means to its original position upon completion of the electrostatic latent image formation.

2. The image forming method as claimed in claim 1, wherein said photosensitive body has an electrically conductive layer and a photoconductive layer, and, in the course of the electrostatic latent image forming step to be effected simultaneously with, or subsequent to, the electric charging, but prior to the image development, the control light of the image region is irradiated onto said photosensitive body through said masking means to eliminate electric charge at said light irradiated region.

3. The image forming method as claimed in claim 1, wherein said photosensitive body has an electrically conductive layer, a photoconductive layer, and a surface insulating layer so as to form an electrostatic latent image on the surface thereof by being subjected to primary corona discharge, simultaneous image exposure and corona discharge, and overall exposure, and the control light of the image region is irradiated onto said photosensitive body through said masking means simultaneously with, or immediately before, the image exposure to eliminate electric charge at said light irradiated region.

4. The image forming method as claimed in claim 1, wherein said photosensitive body has an electrically conductive layer, a photoconductive layer, and a surface insulating layer so as to form an electrostatic latent image on the surface thereof by being subjected to primary corona discharge, simultaneous image exposure and corona discharge, and overall exposure, and the control light of said image region is irradiated onto said photosensitive body during the overall exposure step to be effected after the image exposure, but before the image development to thereby form an electrostatic contrast at said light irradiated region.

5. The image forming method as claimed in claim 1, 2, 3 or 4 wherein said masking means comprises two masking members, each having such a property that when it is not overlapped with the other member it permits light to substantially pass therethrough, and when it is overlapped with the other member it, substantially intercepts light.

6. The image forming method as claimed in claim 1, 2, 3 or 4 wherein said masking means comprises a single masking member and a set of two masking members provided at both ends of said single masking member in a manner to be overlapped therewith, each masking member having such a property that, when it is not overlapped with another member it permits light to substantially pass therethrough, and when it is overlapped with another member, it substantially intercepts the light.

7. The image forming method as claimed in claim 5, wherein said masking means is caused, when said masking members are in their overlapped state, to move across the light path of the control light in synchronism with the movement of the electrostatic latent image bearing portion of the photosensitive body.

8. The image forming method as claimed in claim 5, wherein one of the masking members is fixed to intercept the light path of said control light, and the other masking member is caused to move across said light path in synchronism with the movement of the electrostatic latent image bearing portion of the photosensitive body.

9. The image forming method as claimed in claim 5, wherein one of said masking members is kept in stopped condition to cover the light path of said control light, and the other masking member is caused to move in synchronism with the movement of the first portion which corresponds to the front end of a necessary or unnecessary electrostatic latent image region, and to stop at a place where it is perfectly overlapped with said stopped masking member, and thereafter said previously stopped masking member is caused to move in synchronism with the movement of the second portion which corresponds to the rear end of said electrostatic latent image region.

10. The image forming method as claimed in claim 3, wherein the irradiation of the control light of the image region onto the photosensitive body is directed to either the image region where the light irradiation is effected simultaneously with, or prior to, the image exposure, or the image region after the image exposure, so as to enable formation of the electrostatic latent image in this region, or inhibition of the electrostatic latent image in this region to be selected.

11. The image forming method as claimed in claim 5, wherein formation of the electrostatic latent image in the necessary region or inhibition of the electrostatic latent image in said region can be selected by adding a single masking member to the masking means consisting of two masking members.

12. The image forming method as claimed in claim 6, wherein said masking means is caused, when said masking members are in their overlapped state, to move across the light path of the control light in synchronism with the movement of the electrostatic latent image bearing portion of the photosensitive body.

13. The image forming method as claimed in claim 11, wherein said masking means comprising either two masking members, or a single masking member and a set of two masking members, is caused, when said members are in their overlapped state, to move across the light path of the control light in synchronism with the movement of the electrostatic latent image bearing portion of the photosensitive body.

14. The image forming method as claimed in claim 6, wherein either the single masking member or the set of masking members are fixed to intercept the light path of said control light, and the remaining masking member, either the single member or the set, is caused to move across said light path in synchronism with the movement of the electrostatic latent image bearing portion of the photosensitive body.

15. The image forming method as claimed in claim 11, wherein, of said masking means consisting of two masking members or a single masking member and a set of two masking members, either a single masking member or the set of masking members are fixed to intercept the light path of said control light, and the remaining masking member, either a single member or the set, is caused to move across said light path in synchronism with the movement of the electrostatic latent image bearing portion of the photosensitive body.

16. The image forming method as claimed in claim 6, wherein either the single masking member or the set of two masking members are kept in stopped condition to cover the light path of said control light, and the remaining masking member, either the single member or the set, is caused to move in synchronism with the movement of the first portion which corresponds to the front end of a necessary or unnecessary electrostatic latent image region, and to stop at a place where it is perfectly overlapped with said stopped member, and thereafter said previously stopped masking member is caused to move in synchronism with the movement of the second portion which corresponds to the rear end of said electrostatic latent image region.

17. The image forming method as claimed in claim 11, wherein, of said masking means consisting of two masking members or a single masking member and a set of two masking members, either a single masking member or the set of two masking members are kept in stopped condition to cover the light path of said control light, and the remaining masking member, either a single member or the set, is caused to move in synchronism with the movement of the first portion which corresponds to the front end of a necessary electrostatic latent image region, and to stop at a place where it is perfectly overlapped with said stopped masking member, and thereafter said previously stopped masking member is caused to move in synchronism with the movement of the second portion which corresponds to the rear end of said electrostatic latent image region.

18. An image forming apparatus, wherein an electrostatic latent image is formed on a photosensitive body by electric charging and image exposing steps, and the latent image is developed to form a reproduction image, which comprises in combination:

(a) a light source to irradiate a control light on an image region of the photosensitive body in the course of the electrostatic latent image forming step to be effected simultaneously with or subsequent to the electric charging, or simultaneously with or subsequent to the image exposure, but prior to the image development;

(b) masking means to control the electrostatic latent image forming region by moving masking members constituting said masking means, each having such a property that, in its single form, it permits light to substantially pass therethrough, and, in its overlapped form with the other, it substantially intercepts the light, across the light path from said light source to said photosensitive body in synchronism with movement of the photosensitive body;

(c) means for overlapping said masking members to regulate a light transmission region to said photosensitive body and to control the forming width and the latent image in the direction perpendicular to the travelling direction of said photosensitive body; and (d) means for causing said masking means to move across the light path of the control light from said light source in synchronism with movement of said photosensitive body so as to control the forming width of the latent image along the travelling direction of said photosensitive body.

19. The image forming apparatus as claimed in claim 18, further comprising:

(e) monitoring means having a screen and an optical system to project an image original;

(f) positioning means capable of arbitrarily selecting a setting position of a necessary image region from the image original projected on said screen; and (g) means for controlling the overlapping position of said masking members and a timing for synchronous movement in accordance with a signal from said positioning means.

20. The image forming apparatus as claimed in claim 18 or 19, wherein the masking members constituting said masking means are polarizing plates.

21. The image forming apparatus as claimed in claim 20, wherein said polarizing plates are constructed in such a manner that the polarizing directions thereof may be orthogonally intersected when they are overlapped.

22. The image forming apparatus as claimed in claim 22 or 19, wherein said masking members consist of filters, the wavelength regions of which are divided in such a manner that the light quantity to the photosensitive body may be equal.

23. The image forming apparatus as claimed in claim 18 or 19, wherein said masking members are formed with material having a large light absorption coefficient.

24. The image forming apparatus as claimed in claim 18 or 19, wherein said masking means consists of a combination of a polarizing plate and a liquid crystal.

25. The image forming apparatus as claimed in claim 18 or 19, wherein said light source is an overall exposure lamp.

* * * * *

UNITED STATES PATENT AND TRADEMARK OFFICE

CERTIFICATE OF CORRECTION

PATENT NO. : 4,215,929

DATED : August 5, 1980

INVENTOR(S) : TADASHI SATO, ET AL.

It is certified that error appears in the above-identified patent and that said Letters Patent are hereby corrected as shown below:

Column 10, line 8, "distance" should read --direction--;
line 19, "plate" should read --plates--;
line 59, "for" should read --from--.

Claim 5, Column 20, line 11, "it," should read --,it--.

Signed and Sealed this

*Tenth* Day of *February 1981*

[SEAL]

*Attest:*

RENE D. TEGTMEYER

*Attesting Officer*

*Acting Commissioner of Patents and Trademarks*